United States Patent [19]

Naegele

[11] 4,064,926

[45] Dec. 27, 1977

[54] SAND MOLDING APPARATUS WITH MEANS FOR RECIRCULATING CATALYST

[75] Inventor: Robert Naegele, Erding, Germany

[73] Assignee: Acme-Cleveland Corporation, Cleveland, Ohio

[21] Appl. No.: 686,838

[22] Filed: May 17, 1976

[30] Foreign Application Priority Data

June 16, 1975 Germany ..... 2526875

[51] Int. Cl.[2] ..... B22C 9/12

[52] U.S. Cl. ..... 164/154; 164/12; 164/157; 164/160

[58] Field of Search ..... 164/7, 12, 16, 160, 164/154, 157

[56] References Cited

U.S. PATENT DOCUMENTS 3,919,162 11/1975 Austin ..... 164/12 X

FOREIGN PATENT DOCUMENTS 1,940,924 2/1971 Germany ..... 164/16

1,900,045 8/1970 Germany ..... 164/12

*Primary Examiner*—Robert D. Baldwin

*Attorney, Agent, or Firm*—Woodling, Krost, Granger & Rust

[57] ABSTRACT

Particulate material, hereinafter called sand, is used in a sand article, such as a mold article, for foundry purposes such as a green sand mold and sand core consisting of sand and a binder and is hardened in a molding box by sucking a catalyst gas from a catalyst gas source through the molding box and the sand article. The molding box is continuously exposed to the action of a reduced pressure source and normally evacuated to the atmosphere. When the pressure has been reduced to a predetermined pressure less than atmospheric pressure, the catalyst gas is briefly supplied to the molding box under slight increase of the absolute pressure, whereupon the molding box is evacuated to the catalyst gas source until the pressure therein is reduced to the predetermined pressure to recycle the unused catalyst gas leaving the molding box to the catalyst gas source.

51 Claims, 4 Drawing Figures

SAND MOLDING APPARATUS WITH MEANS FOR RECIRCULATING CATALYST

BACKGROUND OF THE INVENTION

This invention relates to an apparatus for hardening a mold article such as sand molds or sand cores of sand and a binder hardenable by a catalyst gas in molding boxes, in which a reduced pressure source evacuates the molding box to a predetermined pressure less than atmospheric pressure, the catalyst gas is then briefly delivered to the molding box with a slight increase in the absolute pressure, after which the molding box is filled with fresh air and evacuated by means of the reduced pressure source.

Sand molds or sand cores for foundry purposes, which consist of a mixture of sand and a binder, are hardened by means of a catalyst gas which is forced or sucked through the sand molds or sand cores. The catalyst gas initiates a chemical reaction in the binder, only a minimal proportion of the catalyst gas passed through the sand molds or sand cores being consumed. Accordingly, the quantity of catalyst gas issuing from the sand molds or sand cores substantially corresponds to the quantity of catalyst gas delivered to the sand molds.

The catalyst gases used for hardening the sand mold are more or less toxic and dangerous so far as the human organism is concerned. Accordingly, the catalyst gases issuing from the sand molds cannot be let off into the surrounding atmosphere and workshops if physiological damage to personnel is to be avoided.

STATE OF THE KNOWN ART

In one known process for hardening sand molds of sand and a binder by means of a catalyst gas, the molding box containing the compacted sand molds or cores is evacuated to a predetermined reduced pressure. Once this reduced pressure has been reached, the molding box is disconnected from the reduced pressure source and filled with a catalyst gas until the absolute pressure has been increased to a predetermined level. Fresh air is then introduced into the molding box until the absolute pressure in the molding box is increased further to be slightly below atmospheric pressure. The molding box is then reconnected to the reduced pressure source and evacuated to the original reduced pressure. After the molding box has been disconnected from the reduced pressure source, more fresh air is introduced into the molding box until atmospheric pressure prevails in the molding box. The molding box is then opened and the mixture of air and catalyst gas still present in the molding box is removed under suction.

This known process for hardening sand molds comprises a total of two process stages, in which a mixture of air and catalyst gas is removed under suction from the molding box. The mixture removed under suction in the first stage has a higher percentage content of toxic catalyst gas than the mixture removed in the second stage. The mixture of air and catalyst gas from both stages is delivered to a bath in which the catalyst gas is neutralised. This neutralised mixture is then let off from the bath through a pipe into the atmosphere.

In another known, similar process, the catalyst gas removed under suction from the molding boxes is delivered to a combustion chamber which at the same time is connected to feed systems for fresh air and combustible gases. The toxic catalyst gas is intended to be neutralised in the combustion chamber.

The apparatus used for carrying out the processes described above comprise a molding box containing the sand molds or sand cores which is connected through a feed line to a catalyst gas source, through a vent line to the atmosphere and through a suction line to a vacuum pump which evacuates the molding box and sucks the catalyst gas through the sand molds or sand cores. In this known apparatus, the pressure side of the vacuum pump is connected through a line to a purifying plant where the toxic catalyst gas is neutralised or burned.

In conventional processes and apparatus for hardening sand molds or sand cores by means of a toxic catalyst gas, it is necessary, if pollution is to be avoided, to deliver the catalyst gas removed under suction from the molding boxes to a purifying stage in which the catalyst gas is neutralised, eliminated or destroyed. Purifying stages of this kind represent separate, additional units which have to be installed in addition to the apparatus for hardening the sand molds or sand cores. Since the purifying stages require their own supply lines and supply sources, they take up space and are expensive to manufacture and maintain.

Conventional processes and apparatus for hardening sand molds or cores have a very high consumption of catalyst gas, because the catalyst gas removed under suction from the molding boxes is destroyed. This high consumption of catalyst gas makes conventional processes and apparatus even more expensive.

Conventional processes and apparatus comprise strictly separate working stages, in which one working stage is only initiated after the preceding stage has been completed. Accordingly, the working sequence of conventional processes and apparatus is comparable with time-consuming intermittent operation. In addition, the working rate of conventional processes and apparatus is influenced by how quickly the toxic catalyst gases can be destroyed. Accordingly, the work cycle of conventional processes and apparatus is limited, with the result that it is not possible to obtain a high output per unit of time.

SUMMARY OF THE INVENTION

Accordingly, the object of the present invention is to provide a process and an apparatus for hardening sand molds or sand cores by means of a catalyst gas which are inexpensive to carry out and to construct, respectively, and which guarantee that the sand molds and sand cores can be hardened at low cost in large numbers per unit of time without the atmosphere being adversely affected in any way by the catalyst gas.

In the process according to the invention, this object is achieved by virtue of the fact that the molding box is continuously exposed to the action of the reduced pressure source throughout the entire hardening process and, shortly after the beginning of delivery of the catalyst gas, the molding box is evacuated to a reservoir which takes up catalyst gas and releases it again (i.e. acts as a catalyst gas source) and, after the predetermined reduced pressure has been re-established, is evacuated to the atmosphere and, at substantially the same time, is filled with fresh air.

DETAIL DISCUSSION

Since, in the process according to the invention, the molding box is evacuated to the catalyst gas source shortly after the beginning of delivery of the catalyst gas, the unused catalyst gas issuing from the molding box is returned to the catalyst gas source. The returned catalyst gas is available for further use. Accordingly, the process according to the invention eliminates the need for expensive systems for destroying the toxic catalyst gas and, in addition, saves costs because only small quantities of catalyst gas are actually consumed.

Excessive dilution of the catalyst gas sucked back into the catalyst gas source with the air still present in the molding box and in the pipe system is avoided by the fact that the molding box is only evacuated shortly after the beginning of delivery of the catalyst gas, i.e. is only evacuated into the catalyst gas source after the catalyst gas has been sucked through the sand molds and the molding box. In this way, the air present in the molding box and in the line system is removed under suction and kept away from the catalyst gas source, so that it is essentially only the catalyst gas which is introduced into the catalyst gas source. The time lag between the beginning of delivery of the catalyst gas and evacuation of the molding box into the catalyst gas source is governed by the size of the molding box and by the size of the sand molds to be hardened. In general, the time lag is gauged in such a way that the molding box is only evacuated into the catalyst gas source when the catalyst gas introduced begins to issue from the molding box.

The absolute pressure in the molding box, which is less than atmospheric pressure, is increased to a certain extent by the introduction of the catalyst gas. Since, in the process according to the invention, the molding box is always exposed to the action of the reduced pressure source, the reduced pressure gradually is further reduced to its original predetermined level. This is the case when the catalyst gas introduced into the molding box has largely been sucked back into the catalyst gas source. After the reduced pressure has returned to its original level, the molding box is separated from the catalyst gas source and evacuated into the atmosphere. At the moment the molding box is evacuated into the atmosphere, it is simultaneously filled with fresh air so that both the molding box and the sand molds are purged with fresh air. When the molding box is evacuated into the atmosphere, virtually no more catalyst gas is present in the molding box and the sand molds. If in fact small residues of catalyst gas should be left behind in the molding box and in the sand molds in one case or another, these residues are so small that they can be disregarded.

Since, in the process according to the invention, the molding box is continuously exposed to the action of the reduced pressure source, the individual process stages merge smoothly with one another, so that the working sequence is comparable with a continuous process. In this way, it is possible to reach a high working rate and to obtain a rapid work cycle, so that a plurality of sand molds or sand cores can be hardened within a predetermined unit of time.

Accordingly, the process according to the invention enables sand molds and sand cores to be hardened in molding boxes simply, at low cost and at high speed without the surrounding atmosphere being polluted in any way by toxic catalyst gas.

According to the invention, an apparatus which can be manufactured at low cost for the rapid hardening of sand molds and sand cores in a molding box in a time- and cost-saving manner and which is connected to a catalyst gas source through a feed line provided with a shut-off valve, to the atmosphere through a vent line comprising a shut-off valve and to a vacuum pump through a suction line, is distinguished by the fact that the pressure side of the vacuum pump is connected to a reversible valve assembly which, in one position, connects the pressure side of the vacuum pump to a return line leading to the catalyst gas source and, in the other position, connects the pressure side of the vacuum pump to the atmosphere.

When the catalyst gas introduced into the molding box has penetrated through the sand molds or sand cores and has reached the outlet end of the molding box or vacuum pump, the reversible valve assembly of the apparatus according to the invention is reversed in such a way that the catalyst gas is returned to the catalyst gas source. Since, in the apparatus according to the invention, the catalyst gas is not let off into the atmosphere, there is no need for destruction or neutralization of the toxic catalyst gas which would otherwise be absolutely essential for preventing pollution. Another significant advantage of the apparatus according to the invention is that the unused catalyst gas is returned to the working circuit, so that considerable quantities of catalyst gas can be saved.

When the unused catalyst gas has been removed from the molding box, the reversible valve assembly connected to the pressure side of the vacuum pump is again reversed in such a way that the molding box is evacuated into the atmosphere. This prevents pure air from entering the catalyst gas source where it would undesirably dilute the catalyst gas. The point in time at which the unused catalyst gas has largely been removed from the molding box has arrived when the pressure, increased by the introduction of the catalyst gas into the molding box, has fallen back to its original lower starting level under the continuous influence of the vacuum pump.

The reversible valve assembly of the apparatus according to the invention which is connected to the pressure side of the vacuum pump may be manually operated together with the other valves of the apparatus. However, the economy of the apparatus according to the invention may be further increased by operating the reversible valve assembly and the other valves of the apparatus according to the invention in mutual dependence by automatic control systems. In this case, the reversible valve assembly and the other valves may be operated mechanically, pneumatically or electrically according to circumstances and requirements. Particularly advantageous variants of the apparatus according to the invention for increasing its economy are decribed in detail in the Claims and in the exemplary embodiments.

BRIEF DESCRIPTION OF THE DRAWING

Some exemplary embodiments of the invention are described in detail in the following with reference to the accompanying drawings, wherein.

The apparatus according to the invention illustrated in the accompanying drawings are intended for the production of sand cores for foundry purposes. However, the apparatuses according to the invention are equally suitable for the production of sand molds, into which the molten metal is subsequently poured. The sand cores or sand molds are made of a mixture of particulate matter, hereinafter called sand, and a synthetic resin binder, such as urethane, which is hardenable by a catalyst gas.

DESCRIPTION OF THE PREFERRED EMBODIMENTS

Figure 1:
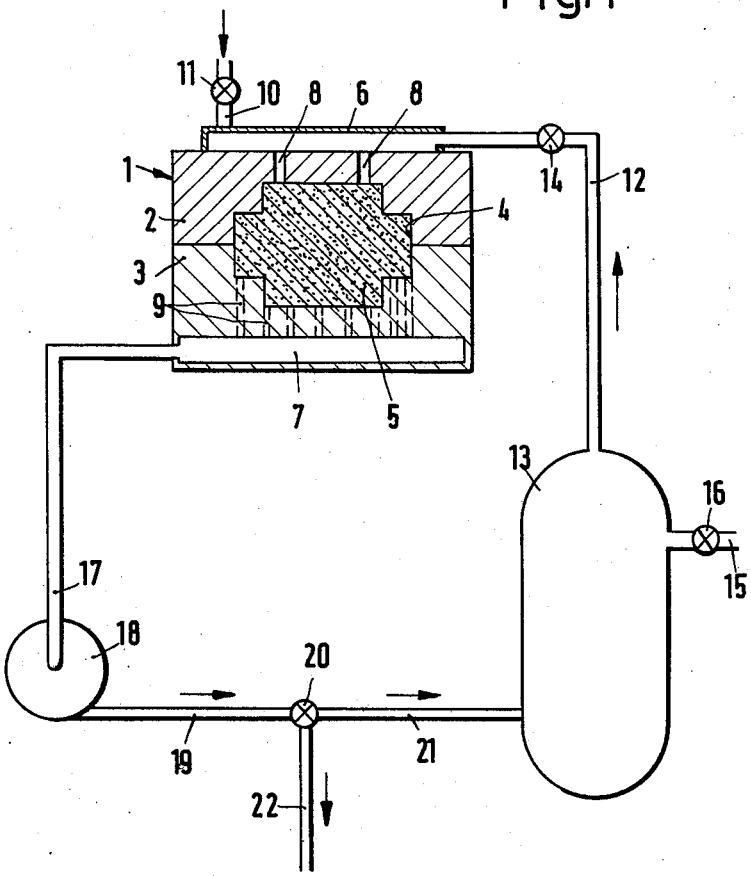
FIGS. 1 to 4 diagrammatically illustrate various embodiments of the apparatus according to the invention.

FIG. 1 shows the simplest embodiment of the apparatus according to the invention for hardening a sand core. A two-piece molding box 1 consisting of an upper box 2 and a lower box 3 comprises a mold cavity 4 for producing and accomodating a sand core 5. The molding box 1 comprises a gassing plate 6 and an evacuation chamber 7. The gassing plate 6 is detachably arranged on the upper box 2 and is connected to the upper box 2 in gas tight manner during the hardening process. The evacuation chamber 7 is accomodated in the lower box 3 of the molding box 1. The mold cavity 4 is connected through feed bores 8 to the gassing plate 6 and through evacuation bores 9 to the evacuation chamber 7.

The gassing plate 6 comprises a vent line 10 with a shut-off valve 11 for the introduction of fresh air into the molding box. The vent line 10 may open directly into the atmosphere or may be connected to a fresh-air blower (not shown).

The gassing plate 6 is further connected through a feed line 12 to a pressure vessel 13, representing the catalyst gas source, in which the catalyst gas is stored under a pressure of from 0.5 to 2.0 atms gauge and preferably under a pressure of from 1 to 1.5 atms gauge. A shut-off valve 14 in the feed line 12 regulates the supply of catalyst gas to the molding box 1. The pressure vessel 13 is provided with an input line 15 through which the catalyst and a carrier gas for the catalyst or a catalyst gas suitable for immediate use can be introduced. The input line 15 is provided with a shut-off valve 16.

The evacuation chamber 7 is connected through a suction line 17 to the suction side of a vacuum pump 18. The pressure side of the vacuum pump 18 communicates through a pressure line 19 with a reversible valve assembly 20 which, in one position, connects the pressure side of the vacuum pump 18 to the pressure vessel 13 through a return line 21 and, in its other position, to the atmosphere through an outlet line 22. In the embodiment illustrated, the reversible valve assembly 20 is a three-way valve. However, the reversible valve assembly 20 may also consist of two shut-off valves (not shown), one of which is provided in the return line 21 and the other in the outlet line 22. By virtue of this arrangement, it is also possible selectively to connect the pressure side of the vacuum pump 18 to the pressure vessel 13 and to the atmosphere.

The production and hardening of a sand core by means of the apparatus according to the invention is described in detail in the following. The molding box 1 is closed by positioning the upper box 2 in gas tight manner on the lower box 3. Instead of the gassing plate 6, a blowhead (not shown) for blowing the mixture of quartz sand and synthetic resin binder into the molding box is initially mounted in gas tight manner on the upper box 2. The valve 14 is closed and the reversible valve assembly 20 is in the position in which it connects the pressure side of the vacuum pump 18 to the atmosphere through the lines 19 and 22. The vacuum pump 18 is then switched on, so that the mold cavity 4 is evacuated to the atmosphere and a reduced pressure built up in the molding box. The reduced pressure prevailing in the molding box is propagated to the blowhead, with the result that some of the sand mixture is sucked out from the blowhead and deposited on to the bottom of the molding box in the form of small piles of sand below the inlet bores 8. When pressure is subsequently applied to the sand mass in the blowhead, the sand mass enters the molding box in the form of sharp jets. The sharp sand jets come into contact with the piles of sand below the inlet bores 8, so that the contours of the molding box below the inlet bores are protected against the sharp sand jets, the tendency of the sand molds to adhere to the molding box is diminished and wear of the molding box reduced. The vacuum pump 18 remains in operation during the blowing process.

After a compacted sand core 5 has been formed in the mold cavity through blowing in of the sand mass, the blowhead is removed and the gassing plate 6 is fastened in gas tight manner to the upper box 2 of the molding box 1. The shut-off valves 11 and 14 are closed and the pressure side of the vacuum pump 18 is connected to the atmosphere. When the vaccum pump 18 has reduced the pressure in the molding box to a value less than atmospheric pressure, herein termed a predetermined pressure, the shut-off valve 14 in the feed line 12 is opened for a short time amounting to between a fraction of a second and several seconds, preferably to between 1 and 3 seconds. The period for which the shut-off valve 14 is open is largely determined by the respective sizes of the mold cavity and the sand core. The catalyst gas flows out of the pressure vessel 13 through the open valve 14 into the molding box and increases the absolute pressure in the molding box, so that the amount of pressure reduction inside the molding box decreases. The vacuum pump 18, which is continuously in operation, sucks the catalyst gas through the sand core 5 and delivers it through the suction bores 9, the evacuation chamber 7, the suction line 17 and the pressure line 19 to the reversible valve assembly 20. The catalyst gas only reaches the reversible valve assembly after a certain time lag after opening of the shut-off valve 14 in the feed line 12. This time lag is essentially governed by the size of the molding box, by the size and density of the core and by the length of the line system between the molding box and the reversible valve assembly 20. Accordingly, this time lag may be determined without difficulty.

When the catalyst gas has reached the pressure line 19 after the predetermined time lag from the opening of the shut-off valve 14 in the line 12, or has arrived at a point just in front of the reversible valve assembly 20, the reversible valve assembly is switched over in such a way that the pressure line 19 is no longer connected to the outlet line 22 leading into the atmosphere, but instead to the return line 21 leading to the pressure vessel 13. The catalyst gas is then returned to the pressure vessel 13 by the vacuum pump 18.

Since the shut-off valves 11 and 14 are closed and since the vacuum pump 18 is continuously in operation, the slightly higher absolute pressure prevailing after introduction of the catalyst gas into the molding box collapses again and is returned to the original predetermined pressure which prevailed before opening of the shut-off valve 14 in the feed line 12. This original predetermined pressure is determined when virtually all the catalyst gas has been removed under suction from the molding box and the associated connecting lines.

After the original reduced pressure has been reached, the reversible valve assembly 20 is again switched over in such a way that the pressure line 19 is connected to the outlet line 22 leading into the atmosphere, so that the molding box 1 is again evacuated into the atmosphere. When the reversible valve assembly 20 is switched back to the atmosphere after the original reduced pressure has been reached, the shut-off valve 11 in the vent line 10 is opened at substantially the same time. The fresh air flowing in through the vent line 10 is sucked through the sand core 5 by the vacuum pump 18, so that the core is purged with fresh air.

By virtue of the apparatus according to the invention, virtually all the unused catalyst gas issuing from the molding box is returned to the pressure vessel 13. If, in exceptional cases, a little residual toxic catalyst gas is in fact present in the sand core or in the molding box at the moment the reversible valve assembly 20 is switched over, these residues of catalyst gas are so small that they can be disregarded and do not represent any potential danger in terms of pollution.

After purging of the sand core, the vacuum pump 18 is switched off and the shut-off valve 11 kept open. The molding box is returned to atmospheric pressure, so that it can be opened and the sand core hardened by the catalyst gas removed from the molding box. Following removal of the sand core, the molding box is closed again and connected to the blowhead. The apparatus is then ready for the next working cycle.

Figure 2:
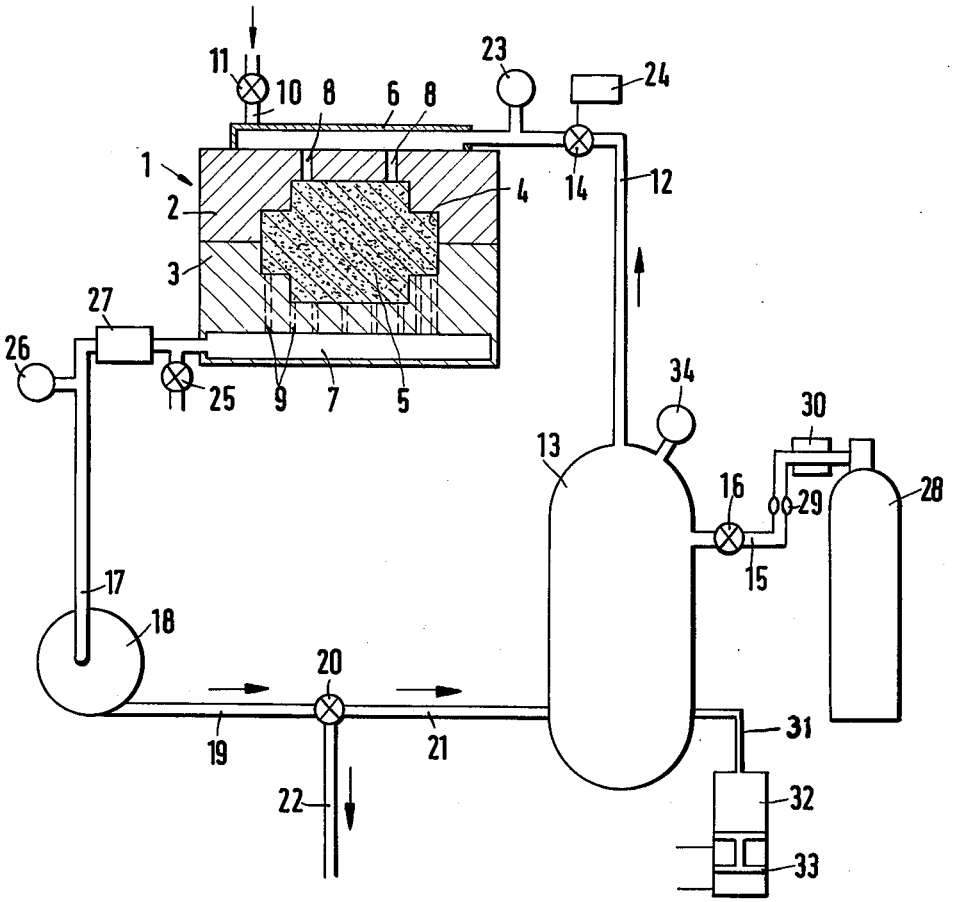

FIG. 2 shows another embodiment which corresponds in its basic structure to the embodiment shown in FIG. 1, the only difference being that additional fittings are present in the feed line 12, in the suction line 17 and in the pressure vessel 13. The components common to both embodiments are denoted by the same reference numerals.

The feed line 12 comprises a control manometer 23 which is arranged between the shut-off valve 14 and the gassing plate 6. The control manometer 23 opens the shut-off valve 14 in the feed line 12 and switches the reversible valve assembly 20 with a certain time lag from the atmosphere to the pressure vessel 13 for the catalyst gas when the reduced pressure in the molding box has reached its predetermined level under the influence of the vacuum pump 18. The time lag between opening of the shut off valve 14 and switchover of the reversible valve assembly 20 corresponds to the time taken by the catalyst gas to flow from the shut-off valve 14 through the sand core 9 to the reversible valve assembly 20.

The shut-off valve 14 in the feed line 12 is connected to a timing device 24 which, irrespective of the pressure conditions prevailing in the molding box and in the line system closes the shut-off valve 14 again after a predetermined interval. The period for which the shut-off valve 14 is open amounts to between a fraction of a second and several seconds and preferably to between 1 and 3 seconds. The times for which the shut-off valve 14 is open are governed by the respective sizes of the molding box and the sand core to be hardened, because large sand cores require a larger quantity of catalyst gas and, hence, a longer open time of the shut-off valve 14 than small sand cores.

The suction line 17 is provided with a venting valve 25 which is used for additionally venting the suction line 17 and the molding box 1 on completion of the hardening process. The venting valve 25 may be arranged at any point of the suction line 17, although it is best arranged in the immediate vicinity of the evacuation chamber 7 in the interests of rapid pressure equalisation in the molding box. When the venting valve 25 is opened on completion of the hardening process, ambient air flows into the evacuation chamber 7 and into the suction line 17 to the vacuum pump 18. There is no need in this case to switch off the vacuum pump, because the pump takes in ambient air through the venting valve 25 and is unable to generate any more reduced pressure in the molding box. Accordingly, the venting valve 25 provides for continuous operation of the vacuum pump 18, thereby eliminating both the need for the pump to be constantly switched on and off and, hence, the unnecessary strain which this places on the system.

The suction line 17 is also provided with a control manometer 26 which is arranged between the venting valve 25 and the vacuum pump 18. The control manometer 26 opens the shut-off valve 11 in the vent line 10 and the venting valve 25 and switches the reversible valve assembly 20 over from the pressure vessel 13 to the atmosphere when the higher pressure prevailing in the molding box through introduction of the catalyst gas has been returned by the pump 18 to the original reduced pressure.

The suction line 17 is also provided with a filter 27 in which any particles of sand sucked out of the molding box are collected and kept away from the vacuum pump 18.

In the embodiment illustrated in FIG. 2, the inlet line 15 of the pressure vessel 13 is connected to a gas cylinder 28 under pressure which contains an inert gas, such as carbon dioxide or nitrogen. The inert gas serves as carrier gas for a catalyst delivered to the pressure vessel 13. The inlet line 15 is provided with a reducing valve 29 and a heating unit 30 between the shut-off valve 16 and the gas cyclinder 28. The reducing valve 29 throttles the pressure of the inert gas flowing out of the gas cylinder 28 into the pressure vessel 13 to the value adjusted in the pressure vessel. The heating unit 30 prevents the inlet line 15 from freezing when the inert gas under high pressure expands and cools as it issues from the pressure cylinder 28.

The pressure vessel 13 is connected through a line 31 to a metering device 32 which delivers a predetermined quantity of catalyst to the pressure vessel 13 by means of a displaceable piston 33.

The pressure vessel 13 is kept at a predetermined temperature and at a predetermined pressure of from 0.5 to 2 atms gauge, preferably from 1 to 1.5 atms gauge. At a predetermined temperature and under a predetermined pressure, the carrier gas takes up a certain quantity of the liquid or gaseous catalyst delivered to the pressure vessel 13. Accordingly, the gas mixture of carrier gas and catalyst which is formed in the pressure vessel always has the same composition. This gas mixture is delivered as catalyst gas to the molding box.

The pressure vessel 13 comprises a control manometer 34 which recloses the shut off valve 16 in the inlet line 15 opened by the control manometer 26 when the pressure in the pressure vessel 13 has reached the predetermined level.

The mode of operation of the apparatus illustrated in FIG. 2, after the sand core has already been compacted in the molding box and the gassing plate 6 fastened to the molding box, is described in detail in the following. The valves 11, 14, and 25 are closed and the reversible valve assembly 20 connects the molding box to the atmosphere. The vacuum pump 18 which operates continuously evacuates the molding box to the atmosphere and produces a predetermined reduced pressure in the molding box. After this predetermined reduced pressure has been reached, the control manometer 23 opens the shut off valve 14 so that the catalyst gas can flow out of the pressure vessel 13 into the molding box.

When, after a certain time lag, the catalyst gas has arrived at a point just in front of the reversible valve assembly 20, the control manometer 23 switches the reversible valve assembly 20 over from the atmoshpere to the pressure vessel 13, so that the catalyst gas is returned to the pressure vessel. After a certain time interval, the shut-off valve 14 is reclosed by the timing device 24, so that the supply of catalyst gas to the molding box is interrupted. The pressure prevailing in the molding box before the shut-off valve 14 was opened is increased by introduction of the catalyst gas to a level lying between the original reduced pressure and the atmospheric pressure. However, the continuously operating vacuum pump 18 gradually reduces this increased pressure by returning the catalyst gas introduced to the pressure vessel. When virtually all the unused catalyst gas has been removed from the molding box and returned to the pressure vessel 13, the reduced pressure returns to its original level which prevailed before the shut-off valve 14 was opened. Once this original reduced pressure has been reached, the control manometer 27 switches the reversible valve assembly 20 over from the pressure vessel to the atmosphere, so that the pressure side of the pump 18 is connected to the atmosphere again. The control manometer 27 simultaneously opens the shut-off valves 11 and 16. The venting valve 25 may be opened either at the same time as or shortly after the shut-off valves 11 and 16 by the control manometer 27.

If the venting valve 25 is opened after the shut-off valve 11 in the vent line 10, the vacuum pump 18 sucks fresh air through the sand core, so that the sand core is purged with fresh air which in turn is discharged into the atmosphere. The subsequently opened venting valve 25 connects the suction side of the vacuum pump 18 to the atmosphere, so that the interior of the molding box is no longer evacuated, but instead is returned to atmospheric pressure under the effect of the inflowing ambient air.

If the venting valve 25 is opened at the same time as the shut-off valve 11, the sand core is not purged with fresh air and atmospheric pressure is immediately built up inside the molding box. When the interior of the molding box has reached atmospheric pressure, the molding box can be opened and the hardened sand core removed.

The shut-off valve 16 opened by the control manometer 27 allows carrier gas to flow into the pressure vessel 13 from the gas cylinder 28. When the pressure in the vessel 13 has returned to its original level, the control manometer 34 closes the shut off valve 16. When the shut-off valve 16 is open, the feed line 12 is kept closed by the shut-off valve 14 and the feed line 21 by the reversible valve assembly 20.

After the hardened sand core has been removed from the molding box and after the molding box has been filled with a green, compacted core, the sequence of operations described above can begin again.

Figure 3:
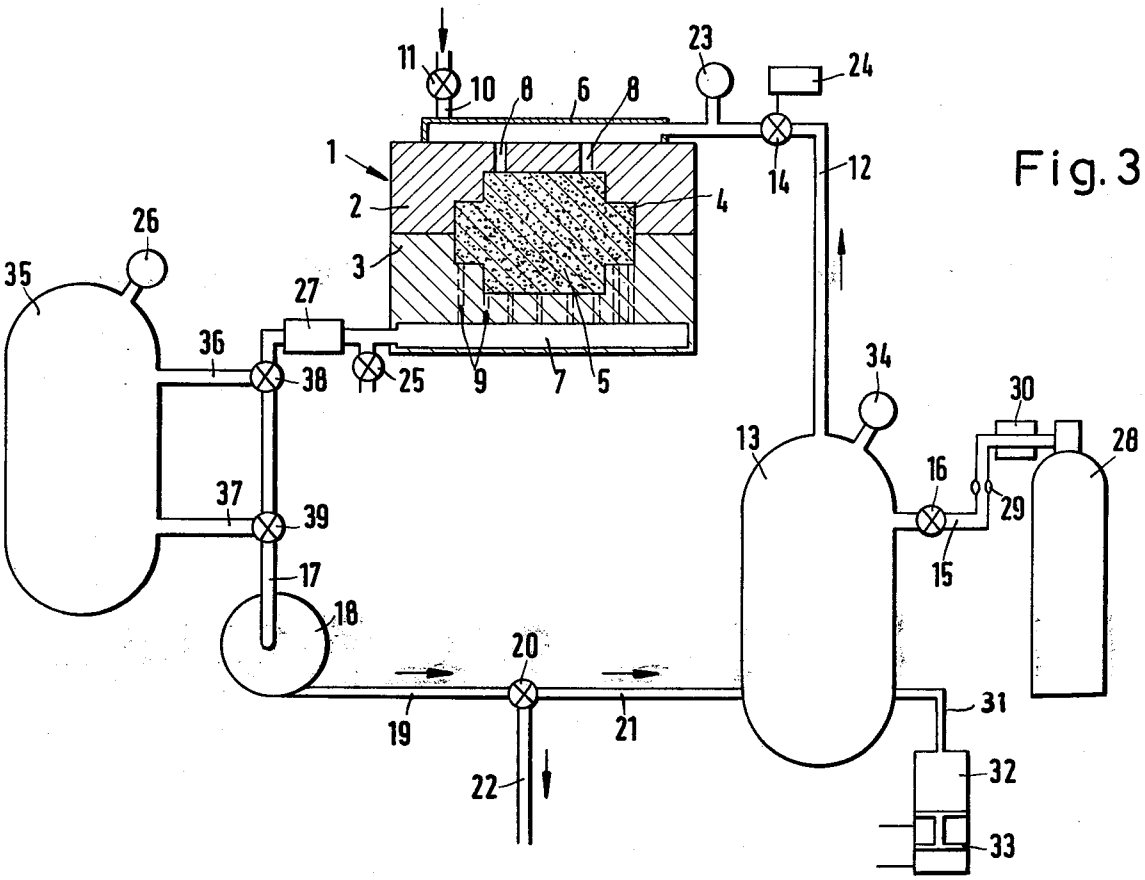

The embodiment illustrated in FIG. 3 substantially corresponds to the embodiment shown in FIG. 2, the only difference being that another fitting is connected to the suction line 17.

In the embodiment illustrated in FIG. 3, the suction line 17 is provided with a bypass line in which a reduced pressure vessel 35 is arranged. In the embodiment illustrated, the bypass line is formed by two branch lines 36 and 37 which connect the reduced pressure vessel 35 to the suction line 17. Reversible valve assemblies 38 and 39 are provided, connecting the molding box to the vacuum pump 18 either directly or through the branch lines and the reduced pressure vessel 35, depending upon their position. In the embodiment illustrated, the reversible valve assemblies 38 and 39 are two three-way valves which are arranged at the junctions between the branch lines 36 and 37 and the suction line 17. However, the reversible valve assemblies 38 and 39 may also be formed by three shut-off valves arranged in each of the branch lines 36 and 37 and in the suction line 17 between the two openings of the branch lines 36 and 37.

In the embodiment illustrated in FIG. 3, the control manometer 26 is connected to the reduced pressure vessel 35. In this embodiment, however, the control manometer 26 could equally well be arranged downstream or upstream of the bypass line in the suction line 17.

The embodiment illustrated in FIG. 3 operates in substantially the same way as the embodiment illustrated in FIG. 2. Accordingly, the mode of operation of the embodiment shown in FIG. 3 is described in the following only where it differs from that of the embodiment illustrated in FIG. 2.

Before the apparatus shown in FIG. 3 is brought into operation, a reduced pressure is generated in the reduced pressure vessel 35 by means of the vacuum pump 18, corresponding to the reduced pressure prevailing in the molding box at the beginning of the hardening process. The reduced pressure vessel 35 may be adjusted to the predetermined reduced pressure, for example by closing the reversible valve assembly 38 to the branch line 36 and opening the reversible valve assembly 39 to the branch line 37 and the reversible valve assembly 20 to the atmosphere. The vacuum pump 18 then evacuates the reduced pressure vessel to the atmosphere until the predetermined reduced pressure has been reached, at which the reversible valve assembly 39 is closed again with respect to the branch line 37.

When the molding box is adjusted to the predetermined reduced pressure at the beginning of the hardening process, the shut-off valves 11 and 14 are closed and the reversible valve assemblies 38 and 39 occupy a position in which the two branch lines 36 and 37 are shut off and the molding box is connected to the atmosphere solely through the line 17, the vacuum pump 18, the pressue line 19, the reversible valve assembly 20 and the outlet line 22. After the predetermined reduced pressure has been reached in the molding box, the control mamometer 23 opens the shut-off valve 14. The control manometer 23 switches over the reversible valve assemblies 38, 39 and 20 with a certain time lag in such a way that the molding box is evacuated into the pressure vessel 13 through the branch line 36, the reduced pressure vessel 35, the branch line 37, the vacuum pump 18, the pressure line 19 and the return line 21. Although the pressure is increased by introduction of the catalyst gas into the molding box, it is gradually returned by the vacuum pump 18 to the orignal predetermined reduced pressure. Once this original reduced pressure has been reached, the control member 26 on the reduced pressure vessel 35 switches over the reversible valve assemblies 38, 39 and 20 in such a way that the branch lines 36 and 37 are shut off and the molding box is evacuated into the atmosphere solely through the line 17, the pressure line 19 and the outlet line 22. The control manometer 26 on the reduced pressure vessel 35 controls the shut-off valves 11 and 16 and the venting valve 25 in the same way as in the embodiment shown in FIG. 2.

The reduced pressure vessel 35 is provided in particular in cases where it is intended to use large molding boxes and to harden large sand molds or sand cores to which it is necessary immediately to apply a very large vacuum which cannot immediately be reached by the vacuum pump 18. Accordingly, the reduced pressure vessel 35 acts as a reduced pressure reservoir for supporting the vacuum pump 18. Accordingly, the reduced pressure vessel 35 is able rapidly to suck the catalyst gas introduced into the molding box through the sand molds or sand cores. The catalyst gas accumulating in the reduced pressure vessel 35 is then gradually returned by the vacuum pump 18 into the pressure vessel 13 until the original predetermined reduced pressure prevails again in the reduced pressure vessel 35. In this way, the reduced pressure vessel 35 simultaneously acts as an intermediate store for the catalyst gas sucked out of the molding box.

The arrows shown in the drawings indicate the directions of flow in the various lines.

The various embodiments of the catalyst according to the invention return the unused catalyst gas sucked out of the molding box to the catalyst gas source. Accordingly, the toxic catalyst gas does not have to be destroyed or neutralised in order to avoid pollution. The apparatus according to the invention are simple and inexpensive in structure and provide for economic operation by virtue of the savings of catalyst gas. However, the greatest advantage of the apparatus according to the invention is that a high working rate can be reached and a plurality of sand molds or sand cores can be hardened in a predetermined unit of time.

Figure 4:
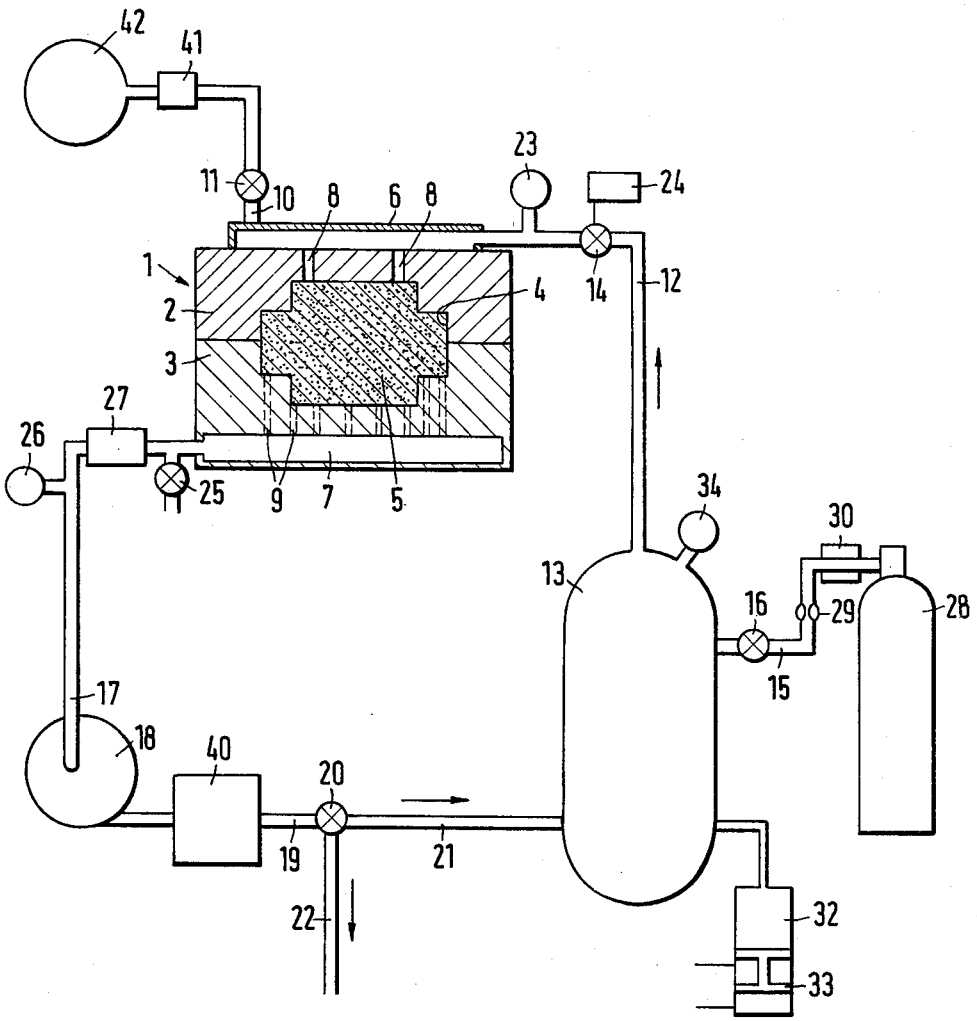

In FIG. 4 a further embodiment of the invention is set forth, which is similar to the embodiment according to FIG. 2 and differs from this substantially in that a freezing dryer 40 is provided in line 19 between the vacuum pump 18 and the reversible valve assembly 20 and in that the vent line 10 is connected with its shut-off valve 11 via a reducing valve 41 to a source 42 for dry air. The same parts of the two embodiments according to FIGS. 2 and 4 have the same reference marks.

When the sand mold 5 has been formed in the molding box 1 and the gassing plate 6 has been placed upon the molding box the procedure of the hardening of the sand core begins. The valves 11, 14 and 25 are closed and the reversible valve assembly 20 connects line 19 via line 22 with the atmosphere. The vacuum pump 18 evacuates the molding box to the atmosphere. The control manometer 23 opens the shut-off valve 14 and switches the reversible valve assembly 20 with a predetermined time lag from the atmosphere to the pressure vessel 13 when a predetermined level of reduced pressure is reached in the molding box. The time lag between opening the shut-off valve 14 and switchover of the reversible valve assembly 20 corresponds to the time taken by the catalyst gas to flow from the shut-off valve 14 through the sand core 5 to the reversible valve assembly.

The shut-off valve 14 is closed by the timing device 24 after a predetermined interval. The period for which the shut-off valve 14 is open amounts to between a fraction of a second and several seconds. The time for which the shut-off valve 14 is open is governed by the respective sizes of the molding box and the sand core to be hardened as well as by the requirement that the proportion of the catalyst gas amounts to a maximum of 1 mole %, based on the total mixture of catalyst gas and air. Hereby, it is ensured that the mixture of catalyst gas and air formed in the lines does not reach an explosive mixing ratio.

When the shut-off valve 14 is closed again the valve 11 in the vent line 10 is opened for a predetermined period of time in order to feed dry presssure air from the dry pressure air source 42 via the reducing valve 41 to the molding box 1. The feeding of catalyst gas and dry pressure air causes an increase of absolute pressure in the interior of the molding box. The catalyst gas and the dry air are sucked through the sand core by means of the vacuum pump 18 and are passed through the freezing dryer 40. The catalyst gas is largely separated in the freezing dryer 40 and is collected in the form of a liquid. The mixture leaving the freezing dryer 40 has only a minor proportion of catalyst gas. This mixture, deficient in catalyst gas, is returned to the pressure vessel 13 via the feed line 21, due to the position of the reversible valve assembly 20.

When the vacuum pump 18 has restored the original predetermined reduced pressure in the molding box and in the line 17, the control manometer 26 again opens the venting valve 25 and switches the reversible valve assembly 20 from the pressure vessel to the atmosphere. At the same time the control manometer 26 opens the shut-off valve 16 so that the pressure vessel 13 again is sufficiently fed with carrier gas from the gas bottle 28. The valve 16 is closed by the control manometer 34 when the predetermined pressure is reached again in the pressure vessel 13.

When the vacuum pump 18 has re-established the original predetermined reduced pressure in the molding box, it can be assumed that the original state before the feeding of the catalyst gas is reached again and that there is no longer any catalyst gas in the molding box and in the line system. The gas which upon switching of the reversible valve assembly 20 is given off to the atmosphere is purified air.

In this embodiment, too, a pollution of the atmosphere has been avoided.

The open venting valve 25 establishes atmospheric pressure in the molding box so that when the molding box is opened, the hardened sand core may be taken therefrom and a new cycle may be started.

In this embodiment it is essential that dry pressure air is used in order to avoid an icing of the freezing dryer 40 and a reduction of the effect of the catalyst gas due to a chemical reaction of the catalyst gas with the moisture contained in the air.

The present disclosure includes that contained in the appended claims, as well as that of the foregoing description. Although this invention has been described in its preferred form with a certain degree of particularlity, it is understood that the present disclosure of the preferred form has been made only by way of example and that numerous changes in the details of construction and the combination and arrangement of parts may be resorted to without departing from the spirit and the scope of the invention as hereinbefore claimed.

I claim:

1. An apparatus for hardening a molding article in a molding box which is connected through a feed line provided with a shut-off valve to a catalyst gas source, through a vent line provided with a shut-off valve to the atmosphere and through a suction line to a vacuum pump which evacuates the molding box and sucks the catalyst gas through the molding article for the purposes of hardening, wherein the improvement comprises a reversible valve assembly having an inlet and first and second outlets, means connecting said inlet to the pressure side of the vacuum pump, means connecting said first outlet to a return line leading to the catalyst gas source and said second outlet to atmosphere, whereby the reversible valve assembly, in one position, connects the pressure side of the vacuum pump to said return line leading to the catalyst gas source and, in the other position, connects the pressure side of the vacuum pump to the atmosphere.

2. An apparatus for hardening sand articles for foundry purposes such as sand molds and sand cores consisting of sand and a binder hardenable by a catalyst gas, comprising a molding box with means for passing air and a catalyst gas therethrough and connected to the atmosphere by a vent line provided with a first shut-off valve, a catalyst gas source connected to said molding box by a feed line provided with a second shut-off valve, a vacuum pumping means having a suction side and a pressure side, said suction side being connected to said molding box by a suction line, and said pressure side being connected to a reversible valve assembly which, in one position, connects said pressure side of the pumping means to the atmosphere and, in the other position, connects said pressure side of the pumping means to a return line leading to said catalyst gas source, means for closing said first and second shut-off valves, means to dispose, and said valve assembly in said one position to evacuate the molding box to the atmosphere and bring it to a predetermined pressure, less than atmospheric pressure, means for briefly opening said second shut-off valve in the feed line upon reaching substantially said predetermined pressure to feed catalyst gas from said catalyst gas source to said molding box causing an increase of the absolute pressure, means to switch said reversible valve assembly to the other position sortly after the beginning of delivery of catalyst gas to evacuate said molding box to said catalyst gas source to re-establish substantially the said predetermined pressure and to recycle the catalyst gas having passed through said sand article in said molding box to said catalyst gas source, means to reverse said reversible valve assembly to said one position and means to open said first shut-off valve in said vent line upon re-establishment of substantially said predetermined pressure to pass fresh air through said molding box and fill it with fresh air.

3. An apparatus as claimed in claim 2, wherein said reversible valve is a three-way valve.

4. An apparatus as claimed in claim 2, wherein there is an absence of obstruction between said molding box and said suction side of said vacuum pumping means.

5. An apparatus as claimed in claim 2, wherein said suction line comprises a first control manometer which, after said predetermined pressure prevailing before the opening of said second shut-off valve in said feed line for the catalyst gas has been substantially reached, opens said first shut-off valve in the vent line and switches said reversible valve assembly over to the atmosphere.

6. An apparatus as claimed in claim 2, wherein said feed line for the catalyst gas comprises between said second shut-off valve and the molding box, a second control manometer which, after the predetermined pressure has been substantially reached in said molding box, opens said second shut-off valve and switches said reversible valve assembly over to the catalyst gas source.

7. An apparatus as claimed in claim 6, wherein said second control manometer provided in the feed line for the catalyst gas switches said reversible valve assembly with a predetermined time lag after the opening of said second shut-off valve in said feed line.

8. An apparatus as claimed in claim 1, wherein said second shut-off valve in the feed line is connected to a timing device which, irrespective of pressure conditions, closes said second shut-off valve after a predetermined time interval governed by the size of said molding box.

9. An apparatus as claimed in claim 1, wherein said suction line comprises a venting valve for rapidly increasing toward atmospheric pressure the reduced pressure in said molding box before it is opened.

10. An apparatus as claimed in claim 9, wherein said suction line comprises a filter downstream of said venting valve.

11. An apparatus as claimed in claim 1, wherein there is an absence of branch lines in the connection from said molding box to said suction side of said vacuum pumping means.

12. An apparatus as claimed in claim 1, wherein said catalyst gas source is a storage vessel filled with a catalyst gas at a pressure between 0.5 and 2.0 atmospheres, gauge pressure.

13. An apparatus as claimed in claim 12, wherein said pressure prevailing in said storage vessel amounts to between 1.0 and 1.5 atms gauge.

14. An apparatus as claimed in claim 12, wherein said storage vessel contains a mixture forming the catalyst gas comprising a carrier gas and a liquid catalyst.

15. An apparatus as claimed in claim 12, wherein said storage vessel contains a mixture forming the catalyst gas comprising a carrier gas and a gaseous catalyst.

16. An apparatus as claimed in claim 12, wherein said storage vessel is connected to a metering device for the supply of catalyst and, through an inlet line comprising a third shut-off valve, to a carrier gas vessel under pressure.

17. An apparatus as claimed in claim 16, wherein said inlet line between said carrier gas vessel and said storage vessel comprises a reducing valve.

18. An apparatus as claimed in claim 16, including means to open said third shut-off valve in said inlet line between said carrier gas vessel and storage vessel only when said second shut-off valve in the feed line is closed and when said pressure side of said vacuum pumping means is connected to the atmosphere through said reversible valve assembly.

19. An apparatus as claimed in claim 16, wherein said carrier gas vessel is filled with inert gases such as carbon dioxide and nitrogen.

20. An apparatus for hardening sand articles for foundry purposes such as sand molds and sand cores consisting of sand and a binder hardenable by a catalyst gas, comprising a molding box with means for passing air and a catalyst gas therethrough and connected to the atmosphere by a vent line provided with a first shut-off valve, a catalyst gas source connected to said molding box by a feed line provided with a second shut-off valve, a vacuum pumping means having a suction side and a pressure side, said suction side being connected to said molding box by a suction line and said pressure side being connected to a reversible first valve assembly which, in one position, connects said pressure side of the pumping means to the atmosphere and, in the other position, connects said pressure side of the pumping means to a return line leading to said catalyst gas source, a reduced pressure vessel arranged in a bypass line connected to said suction through a second reversible valve assembly which, in one position, blocks said bypass line and, in the other position, switches the flow-path over to said bypass line, means to dispose said first and second shut-off valves and said first and second reversible valve assemblies in said one position to evacuate said molding box to the atmosphere to reduce it to a predetermined pressure less than atmospheric pressure, means to briefly open said second shut-off valve in the feed line upon reaching substantially said predetermined pressure to feed catalyst gas from said catalyst gas source to said molding box causing an increase of the absolute pressure, means to switch said first and second reversible valve assemblies to the other position shortly after beginning delivery of said catalyst gas to evacuate said molding via said reduced pressure vessel into said catalyst gas source to re-establish substantially the predetermined pressure in said molding box and to recycle said catalyst gas having passed through said sand article in the molding box to said catalyst gas source, means to reverse said first and means to open second valve assemblies to said one position and the first shut-off valve in the vent line upon re-establishment substantially of said predetermined pressure to pass fresh air through said molding box and fill it with fresh air.

21. An apparatus as claimed in claim 20, wherein said first reversible valve assembly is a three-way valve.

22. An apparatus as claimed in claim 20, wherein said second reversible valve assembly for said bypass line comprises two three-way valves arranged at the junctions between said bypass line and said suction line.

23. An apparatus as claimed in claim 20, wherein said reduced pressure vessel comprises a first control manometer which, upon reaching substantially said predetermined pressure prior to opening said second shut-off valve for the carrier gas, opens said first shut-off valve in the vent line and switches said first and second reversible valve assemblies to said one position, in which the flow-path runs from said molding box directly to said vacuum pumping means and from there to the atmosphere.

24. An apparatus as claimed in claim 20, wherein said feed line for the catalyst gas comprises between said second shut-off valve and the molding box a second control manometer which, upon reaching substantially said predetermined pressure in the molding box, opens said second shut-off valve and switches said first and second reversible valve assemblies to said other position, in which the flowpath from said molding box runs via said reduced pressure vessel to said vacuum pumping means and from there to said catalyst gas source.

25. An apparatus as claimed in claim 24, wherein said second control manometer provided in said feed line for the catalyst gas switches said first and second reversible valve assemblies with a predetermined time lag after opening of said second shut-off valve in the feed line.

26. An apparatus as claimed in claim 20, wherein said second shut-off valve in the feed line is connected to a timing device which, irrespective of pressure conditions, closes said second shut-off valve after a predetermined time interval governed by the size of said molding box.

27. An apparatus as claimed in claim 20, wherein said suction line comprises a venting valve for rapidly increasing toward atmospheric pressure the reduced pressure in said molding box before it is opened.

28. An apparatus as claimed in claim 27, wherein said suction line comprises a filter downstream of said venting valve.

29. An apparatus as claimed in claim 20, wherein said catalyst gas source is a storage vessel filled with a catalyst gas at a pressure between 0.5 and 2.0 atms. gauge pressure.

30. An apparatus as claimed in claim 29, wherein said pressure prevailing in said storage vessel amounts to between 1.0 and 1.5 atms. gauge.

31. An apparatus as claimed in claim 29, wherein said storage vessel contains a mixture forming the catalyst gas comprising a carrier gas and a liquid catalyst.

32. An apparatus as claimed in claim 29, wherein said storage vessel contains a mixture forming the catalyst gas comprising a carrier gas and a gaseous catalyst.

33. An apparatus as claimed in claim 29, wherein said storage vessel is connected to a metering device for the supply of catalyst and through an inlet line comprising a third shut-off valve to a carrier gas vessel under pressure.

34. An apparatus as claimed in claim 33, wherein said inlet line between said carrier gas vessel and said storage vessel comprises a reducing valve.

35. An apparatus as claimed in claim 33, including means to open said third shut-off valve in said inlet line between carrier gas vessel and storage vessel only when said second shut-off valve in the feed line is closed and when said pressure side of the said vacuum pumping means is connected to the atmosphere through said first reversible valve assembly.

36. An apparatus as claimed in claim 33, wherein said carrier gas vessel is filled with inert gases such as carbon dioxide and nitrogen.

37. An apparatus for hardening sand articles for foundry purposes such as sand molds and sand cores consisting of sand and a binder hardenable by a catalyst gas, comprising in combination, a molding box with means for passing dry air and a catalyst gas therethrough and connected to a pressurized dry air source by a vent line provided with a first shut-off valve, a catalyst gas source connected to said molding box by a feed line provided with a second shut-off valve, a vacuum pumping means having a suction side and a pressure side, said suction side being connected to said molding box by a suction line provided with a third vent valve to connect said molding box to the atmosphere and said pressure side being connected to a freezing dryer means for separating a substantial amount of said catalyst gas from a mixture consisting of catalyst gas and dry air coming from said molding box and passing through said freezing dryer means, a reversible valve assembly which is connected to said freezing means and which, in one position, connects said pressure side of the pumping means via said freezing dryer means to the atmosphere and, in the other position, connects said pressure side of the pumping means via said freezing dryer means to a return line leading to said catalyst gas source, control means to close said first and second shut-off valves and to establish said valve assembly in said one position to evacuate the molding box to the atmosphere and bring it to a predetermined pressure less than atmospheric pressure, said control means adapted for breifly opening said second shut-off valve in the feed line upon reaching substantially said predetermined pressure in said molding box to feed catalyst gas from said catalyst gas source to said molding box, said control means adapted for opening said first shut-off valve in said vent line for pressurized dry air for a predetermined period of time upon closing said second shut-off valve in the feed line for the catalyst gas to feed dry air to said molding box, said feeding of catalyst gas and dry air causing an increase of the absolute pressure in said molding box, said control means adapted for switching said reversible valve assembly to the other position shortly after the beginning of delivery of catalyst gas to evacuate said molding box to said catalyst gas source to re-establish substantially the said predetermined pressure and to recycle the residual catalyst gas leaving said freezing dryer means to said catalyst gas source, said control means adapted for switching said reversible valve assembly to said one position and opening said third vent valve in said suction line upon re-establishment of substantially said predetermined pressure to build up atmospheric pressure in said molding box.

38. An apparatus as claimed in claim 37, wherein said reversible valve assembly is a three-way valve.

39. An apparatus as claimed in claim 37, wherein said control means includes in said suction line a first control manometer which, after said predetermined pressure prevailing before the opening of said second shut-off valve in said gas feed line has been substantially reached, opens said third vent valve in the suction line and switches said reversible valve assembly over to the atmosphere.

40. An apparatus as claimed in claim 37, wherein said control means includes in said gas feed line a second control manometer between said second shut-off valve and said molding box, which manometer, after the predetermined pressure has been substantially reached in said molding box, opens said second shut-off valve and switches said reversible valve assembly over to the catalyst gas source.

41. An apparatus as claimed in claim 40, wherein said second control manometer switches said reversible valve assembly with a predetermined time lag after the opening of said second shut-off valve in said gas feed line.

42. An apparatus as claimed in claim 37, wherein said control means includes a timing device connected to said second shut-off valve in the gas feed line, which timing device, irrespective of pressure conditions, closes said second shut-off valve after a predetermined time interval governed by the size of said molding box.

43. An apparatus as claimed in claim 37, wherein said suction line comprises a filter downstream of said third vent valve.

44. An apparatus as claimed in claim 37, wherein said catalyst gas source is a storage vessel filled with a catalyst gas at a pressure between 0.5 and 2.0 atmospheres gauge pressure.

45. An apparatus as claimed in claim 44, wherein said pressure prevailing in said storage vessel amounts to between 1.0 and 1.5 atmosphere gauge.

46. An apparatus as claimed in claim 44, wherein said storage vessel contains a mixture forming the catalyst gas comprising a carrier gas and a liquid catalyst.

47. An apparatus as claimed in claim 44, wherein said storage vessel contains a mixture forming the catalyst gas comprising a carrier gas and a gaseous catalyst.

48. An apparatus as claimed in claim 44, wherein said storage vessel is connected to a metering device for the supply of catalyst and, through an inlet line comprising a fourth shut-off valve, to a carrier gas vessel under pressure.

49. An apparatus as claimed in claim 48, wherein said inlet line between said carrier gas vessel and said storage vessel comprises a reducing valve.

50. An apparatus as claimed in claim 48, wherein said fourth shut-off valve in said inlet line between said carrier gas vessel and storage vessel only when said second shut-off valve in the feed line is closed and when said pressure side of said vacuum pumping means is connected to the atmosphere through said reversible valve assembly.

51. An apparatus as claimed in claim 48, wherein said carrier gas vessel if filled with inert gases such as carbon dioxide and nitrogen.

* * * * *